United States Patent [19]

Browning

[11] Patent Number: 4,715,760

[45] Date of Patent: Dec. 29, 1987

[54] HOIST FOR INSTALLING CABINETS, CEILING FRAMES AND THE LIKE

[76] Inventor: Ervin R. Browning, P.O. Box 430, Carlsbad, Calif. 92008

[21] Appl. No.: 921,306

[22] Filed: Oct. 22, 1986

[51] Int. Cl.[4] ..... E04G 1/00; E04G 21/14

[52] U.S. Cl. ..... 414/10; 254/93 H; 254/134; 269/904

[58] Field of Search ..... 414/10, 11, 589; 254/93 H, 134; 269/904; 248/354.1, 354.5, 354.6

[56] References Cited

U.S. PATENT DOCUMENTS

| | | | |
|---|---|---|---|
| 2,214,440 | 9/1940 | Rothery | 254/93 H |
| 2,227,460 | 1/1941 | Morgensen | 248/354.6 X |
| 2,330,518 | 9/1943 | Rothery | 254/93 H X |
| 2,802,635 | 8/1957 | Engelbart | 254/134 X |
| 4,340,205 | 7/1982 | Leezer | 414/11 X |
| 4,482,130 | 11/1984 | Paredes | 414/11 X |
| 4,624,447 | 11/1986 | Richmeier | 254/93 H |

*Primary Examiner*—Leslie J. Paperner
*Attorney, Agent, or Firm*—Millen & White

[57] ABSTRACT

A pneumatic hoist is provided for lifting cabinets, ceiling frames, and the like. The hoist includes a tripod base and manual structure for an initial height adjustment.

13 Claims, 7 Drawing Figures

HOIST FOR INSTALLING CABINETS, CEILING FRAMES AND THE LIKE

BACKGROUND OF THE INVENTION

The instant invention relates to hoists for cabinets, ceiling frames, and the like; and more particularly, the instant invention relates to pneumatic hoists for cabinets, ceiling frames and the like which hoists are readily adjustable for the purpose intended.

Normally, when installing cabinets, such as kitchen cabinets or other types of elevated cabinets, it is necessary for a helper to lift the cabinet in place against a wall while the cabinet is secured by an installer. The procedure requires the labor of at least two people. In addition, lifting cabinets can cause back injuries and other medical problems. Helpers for cabinet installers do not work for free and the need for additional labor necessarily adds expense to any project.

If the installer does not have a helper, then the installer must use props of some type under the cabinet or must simply be strong enough to hold the cabinet up with one hand while fastening it with the other. These approaches are usually clumsy, unsatisfactory and dangerous. However, there are several drawbacks to using another person as helper. For example, it is very difficult for a helper to hold a cabinet steady in the selected or proper position. In addition, the helper is usually directly in the installer's way.

The prior art includes U.S. Pat. Nos. 1,725,329; 4,027,802; and 3,365,080 which are directed to installing ceiling frames. While these devices disclose hoists for lifting ceiling frames, they do not disclose devices which are suitable for installing cabinets. U.S. Pat. No. 1,725,329 discloses a device for cranking up a platform; however, there is nothing in this device which suggests that it could be conveniently used for cabinets in that the platform is too large to fit under cabinets. Moreover, the device has wheels which can be caught in debris and has a base which is not elevated enough to avoid debris. Neither U.S. Pat. No. 4,027,802 nor U.S. Pat. No. 3,365,080 are suitable for lifting cabinets in that again neither has a suitable platform and both are mounted on wheels or rollers which are not suitable for use at building sites where floors are usually strewn with debris.

In view of the aforementioned considerations, it is an object of the instant invention to provide a new and improved apparatus which is especially useful for lifting cabinets, and readily adaptable for lifting ceiling frames, ceiling frames or the like, wherein the apparatus may be substituted for at least one installation helper.

SUMMARY OF THE INVENTION

In view of the foregoing object and other objects, the instant invention contemplates a lifting device for hoisting items such as wall mounted cabinets, ceiling frames and the like, wherein the lifting device includes a tripod support having three feet for resting the device on a floor and a fixed tube supported within the tripod. A fluid cylinder is telescopically received within the fixed tube and a plurality of stations are defined on the fixed tube for receiving stop means to longitudinally position the fluid cylinder in the tube at a selected one of the stations. A line is connected to the fluid cylinder for pressurizing the fluid cylinder to move a piston within the fluid cylinder so as to extend longitudinally upon pressurizing the fluid cylinder. Extension means extend from the piston means for longitudinal movement therewith, the extension means has a distal end and a supporting platform mounted on the distal end of the extension means for supporting the object to be lifted.

Upon further study of the specification and appended claims, further objects and advantages of this invention will become apparent to those skilled in the art.

BRIEF DESCRIPTION OF THE DRAWINGS

Various other otjects, features and attendant advantages of the present invention will be more fully appreciated as the same becomes better understood when considered in connection with the accompanying drawings, in which like reference characters designate the same or similar parts throughout the several views, and wherein.

DETAILED DESCRIPTION

Figure 1:
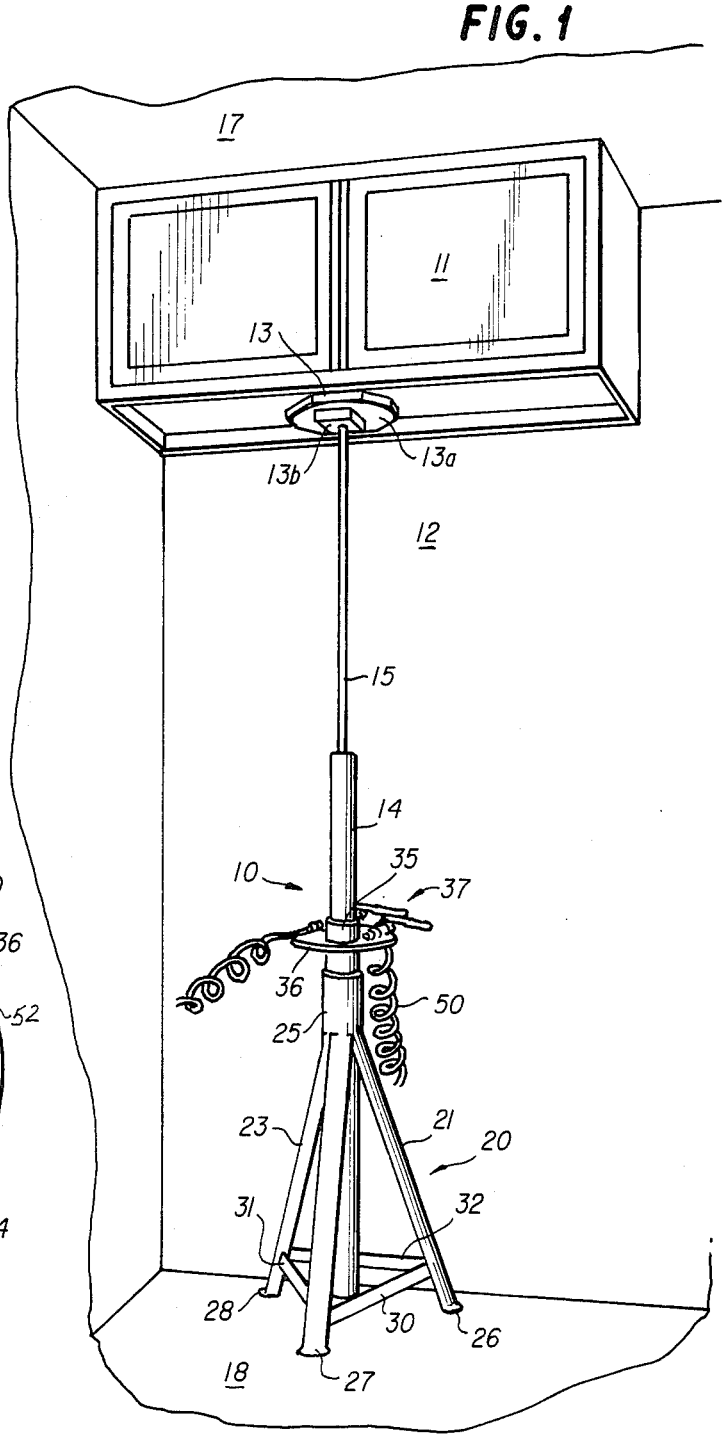
FIG. 1 is a perspective view of the hoist configured in accordance with the principles of the instant invention showing the hoist positioning a cabinet, relatively high on a wall for installation.

Referring now to FIG. 1, there is shown a hoist, designated generally by the numeral 10, for hoisting cabinets, ceiling frames and the like into position for installation. In accordance with a primary use of the hoist 10, the hoist lifts a cabinet 11 to a desired height on a wall 12 so that the cabinet 11 can be secured to the wall by passing screws through the cabinet into studs behind the wall. As will be explained hereinafter, the hoist 10 is both manually and pneumatically adjustable in the vertical direction so as to position a cabinet at a desired height. Generally, the hoist 10 is used by first lifting the cabinet onto a platform 13 and then pneumatically pressurizing a pneumatic cylinder 14 to extend a piston rod 15 attached to the platform 13 in order to lift the cabinet 11 the remainder of the distance.

Figure 2:
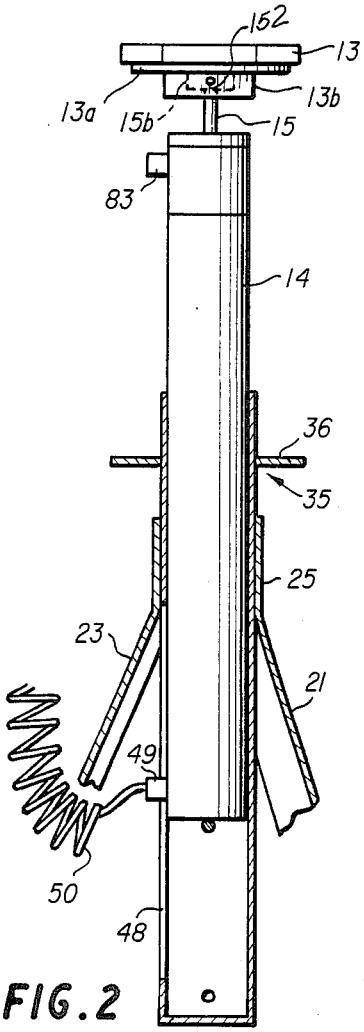
FIG. 2 is a side view, partially in section, showing a portion of the hoist of FIG. 1 and showing how a pneumatic line for powering the hoist is accomodated within support structure.
Figure 7:
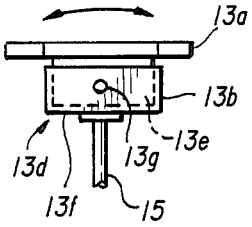
FIG. 7 is a side view of a wobble plate connection which allows a cabinet being lifted by the hoist to tilt each slightly against a wall.

The platform 13 is preferably hexagonal in shape and made of wood so that it will not scratch the bottom of the cabinet 11 being installed. Plate 13 is rigidly secured to a metal mount plate **13*a* and a support bracket 13*b*. As is seen in FIG. 2, the piston rod 15 has a threaded end 152 which receives a nut 15*b* so as to somewhat loosely mount the bracket 13*b* on the piston rod. Accordingly, the platform 13 can be tilted slightly so as to help position the cabinet 11. Alternatively, a wobble plate 13*d* such as is shown in FIG. 7 may be utilized wherein the platform 13 is attached to the upper U-shaped bracket 13*e*** which is pivoted to a lower U-shaped bracket 13*f* by bolts 13*g*. The upper U-shaped bracket rocks slightly with respect to the lower U-shaped bracket in order to allow platform 13 to tilt.

Figure 3:
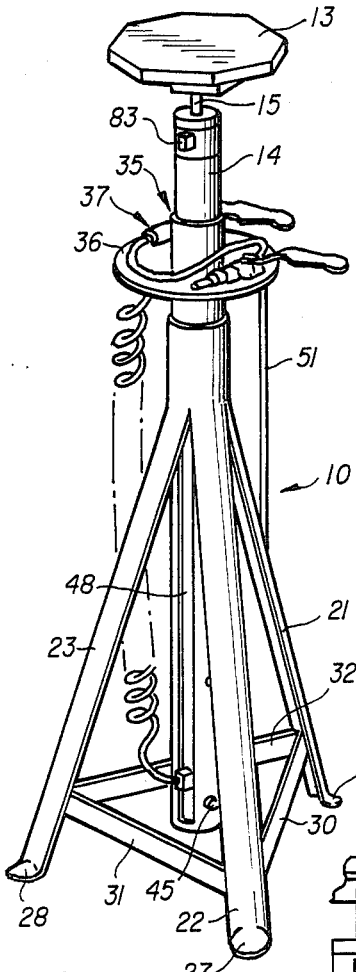
FIG. 3 is a perspective view of the hoist shown in FIG. 1, but showing the hoist in its lowermost position.

In FIG. 1, the hoist 10 is shown lifting a cabinet 11 to a position in abuttment with a ceiling 17, which is perhaps spaced eight feet from a floor 18. Normally, cabinets such as kitchen cabinets, are mounted at a lower level, in which case the hoist 10 has an initial position, such as that shown in FIG. 3, wherein the platform 13 is at waist height so that the installer need not lift a cabinet 11 above his waist in order to place the cabinet on the platform.

Figure 5:
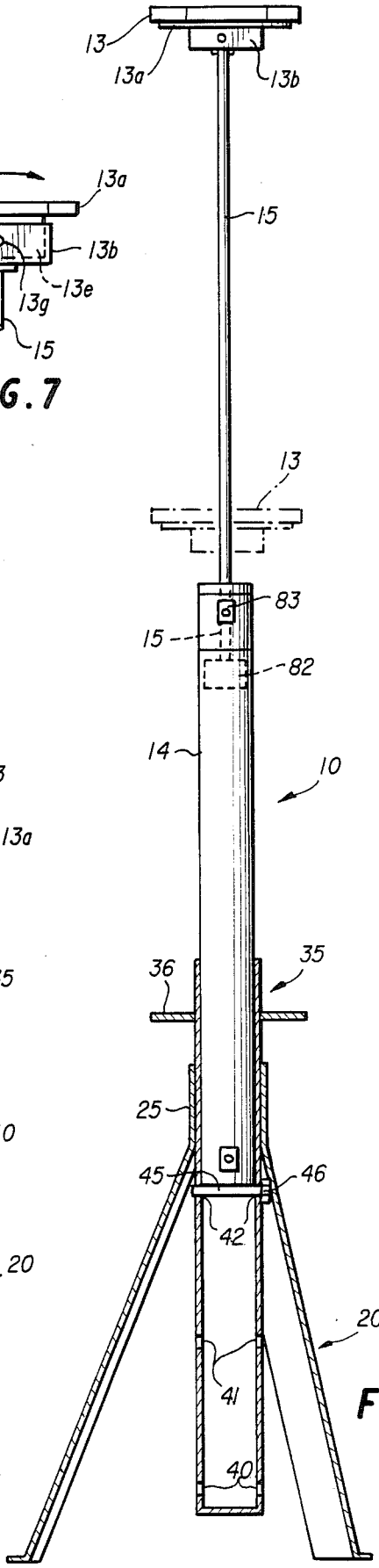
FIG. 5 is a side view, partially in section, of the hoist configured in the mode shown in FIG. 1 with a supporting platform shown extended from a low position, shown in dotted lines, to a fully extended vertical position, shown in solid lines.

As is seen in FIG. 5, the hoist 10 has sufficient vertical range to lift an object such as a ceiling frame, should it be desirable to use the hoist for such a purpose. For such a use, the toist 10 is initially, manually raised to its highest manual height and then is pneumatically extended in order to lift the ceiling frame into abuttment with the beams to which it is secured.

Considering the hoist 10 more specifically, it is seen that the hoist 10 is supported by a tripod, designated generally by the numeral 20. The tripod 20 has first, second and third legs 21, 22 and 23, each of which is struck from a tube having a remaining tubular portion or collar 25. The legs 21, 22 and 23 have feet 26, 27 and 28, respectively, and each foot has a relatively small horizontally extending bottom surface so as to rest securely on the floor 18 without damaging the floor, should the floor be finished in someway. The legs 21–23 are braced by three braces 30, 31 and 32, which are welded in place and spaced from the feet 26–28. Frequently, floors 18 at construction sites are littered with debris. By having relatively small feet 26–28 and spacing the braces 30–32 from the floor, the tripod 20 can sit stabley in debris. A wheeled support for a hoist such as the hoist 10 would simply not work very well since debris would block the wheels from rotating and perhaps clog the wheels. In addition, the hoist 10 might tend to slide away from the wall and cause the cabinet 11 to tumble from its perch onto the installer. While at first blush, it might appear that a wheeled dolly would be preferable to a stationary tripod, the inventor discovered that wheeled dollies are inconvenient as well as unsafe.

Received in the upper tubular portion 25 of the tripod 20 is a tube, designated generally by the numeral 35, which is welded or otherwise fixed within the tubular portion 25 of the tripod. The tube 35 extends both above and below the tubular portion 25 and is spaced from the plane including feet 26–28 so as to accomodate debris which may be under the hoist 10. The tube 35 has a control panel 36 welded or otherwise fixed thereto at slightly lower than waist height to support a pneumatic control system, designated generally by the numeral 37 (see FIG. 6).

Figure 4:
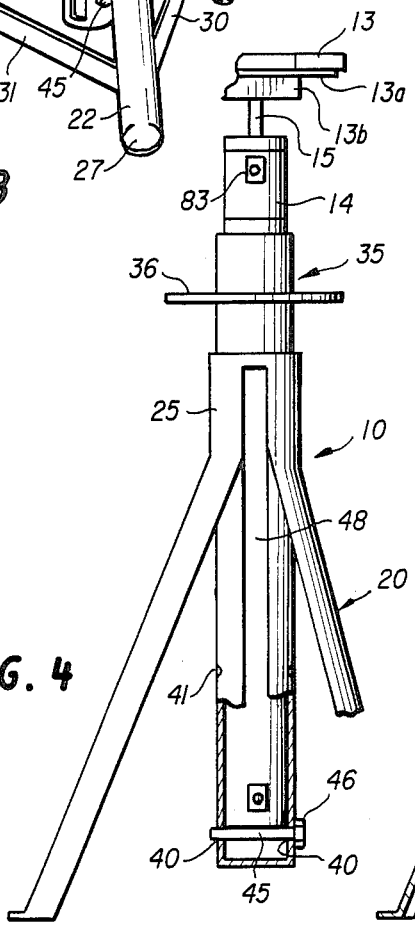
FIG. 4 is a side view, partially in section, of the hoist configured in the mode shown in FIG. 3.

As is best seen in FIGS. 4 and 5, the tube 35 has a plurality of pairs of vertically spaced holes 40, 41 and 42 which are horizontally aligned to receive a pin 45 that has a head 46 thereon so as to stop the pin and hold it in place. One pair of the holes 40–42 is selected to provide a station for positioning the pin 45 so as to manually adjust the initial height of the platform 13. A vertically extending slot 48 is provided in the tube 35 to accomodate a nipple fitting 49 for a pneumatic line 50 which is connected to the pneumatic cylinder 14 received in tube 45. The pneumatic cylinder 14 rests on pin 45 at a selected pair of the holes 40–42 so as to initially manually position the pneumatic cylinder and thus the platform 13.

A carrying handle 51 is welded to the control panel 36 at one end and to the strut 21 at the other end. Preferably, the carrier handle 51 is a solid rod. Since the carrying handle 51 is elongated, the installer can easily locate the center of gravity thereof which makes the hoist 10 easy to carry. A hole 52 is provided in the control panel 36 to support the screw gun shank used in driving the screws to secure the cabinets. The screw gun (not shown) can lean outward, out of the way of the platform 13, when the platform is at its lowest position (see FIGS. 3 and 4).

Figure 6:
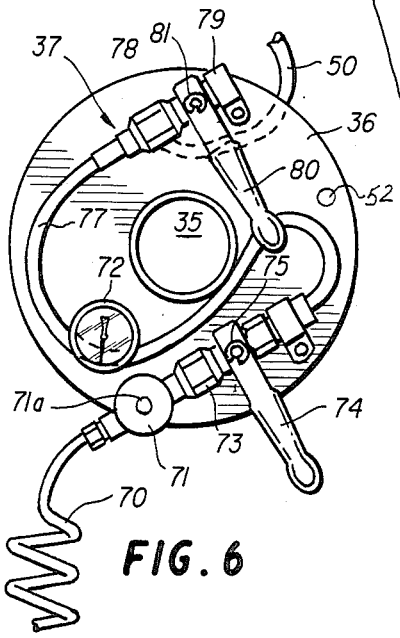
FIG. 6 is a top view of a control system used with the hoist.

Referring now to FIG. 6, where the pneumatic control system 37 is shown, pressurized air from an air compressor, portable pressurized tank, or the like is applied over "mini coil" pneumatic line 70 which is connected through an air pressure regulator 71, having a gauge 72 associated therewith and through a ball check valve 73 which is controlled by a handle 74. The air pressure regulator 71 allows incoming air pressure to be reduced to a safe and suitable working prssure. This pressure is pre-set by the adjusting knob 71*a* on the regulator 71 and appears on the regulator gauge 72. This pressure can be increased or decreased during operation as needed. Excess pressure can cause too quick a response from the lifting piston 82 and too low a pressure will not lift the object desired. Upon pivoting the handle 74 horizontally about an axis 75, the ball check valve 73 is opened, allowing the pressurized air to flow through pneumatic line 77 to a T-valve 78. The T-valve 78 has one outlet connected to the pneumatic pressure line 50 (which passes through an opening in panel 36) and the other outlet connected to an exhaust ball check valve 79 which is operated by a handle 80 that pivots about an axis 81. The pneumatic control system 37 is operated by first opening the valve 73 with the handle 74. This pressurizes air in pneumatic line 50 passing into the nipple fitting 49 pressurizing the cylinder 14 thereby causing the piston 82 and piston rod 15 to rise in the cylinder 14. This in turn causes the platform 13 to lift an object placed thereon. The rate at which the platform 13 rises is readily controlled by operating handle 74. When the platform 13 is positioned at the appropriate height, the handle 74 is rotated to close the valve 75 so that the piston rod 15 remains extended and the platform 13 remains at the selected vertical position. When it is desired to lower the platform 13, valve 79 is opened by rotating handle 80 so as to exhaust air from the pneumatic cylinder 14 via line 50.

An air flow control valve 83 is placed at the top of the pneumatic cylinder 14 so that by an adjustment provided, the air, as it is pushed up on the top side of the piston 82 when the lower chamber is pressurized, can be expelled at a measured rate of flow. This controls the upward speed of the piston 82 and piston rod 15. As the piston 82 and piston rod 15 travel downward, by weight on the platform 13, the downward speed is controlled by the measured amount of air allowed to enter the air flow control valve 83.

The ascent and descent of the platform 13 is normally controlled by the intake valve 73 and the exhaust valve 79. However, should either of these values 73 or 79 be opened in the full position sudddenly, the air flow control valve 83 will prevent a sudden rise or fall of the platform 13 that could endanger the operator or object being lifted.

From the foregoing description, one skilled in the art can easily ascertain the essential characteristics of this invention, and without departing from the spirit and scope thereof, can make various changes and modifications of the invention to adapt it to various usages and condi- tions.

What is claimed is:

1. A lifting device for hoisting wall mounted cabinets, ceiling frames and the like, the lifting device comprising:

a tripod support having three legs each having an upper end and a lower end, feet positioned at the lower ends of each of the legs to provide three spaced supports for the device and annular means for connecting the legs to one another adjacent the upper ends thereof;

a single tube fixed in the annular means and extending a substantial distance down between the legs of the tripod support;

a fluid cylinder telescopically received within the single tube;

a plurality of stations defined in the single tube for receiving stop means to longitudinally position the fluid cylinder in the single tube at a selected one of the stations;

means connected to the fluid cylinder for pressurizing the cylinder;

piston means within the fluid cylinder for extending longitudinally upon pressurizing the fluid cylinder;

extension means extending from the piston means for longitudinal movement therewith, the extension means having a distal end; and a supporting platform mounted on the distal end of said extension means for supporting the object to be lifted.

2. The lifting device of claim 1, wherein the means for pressurizing the fluid cylinder includes an fluid hose connected to the bottom end of the fluid cylinder and wherein the tube telescopically receiving the fluid cylinder has a slot in the wall thereof extending longitudinally with respect thereto through which slot the fluid line is received, whereby the fluid line can conveniently follow the fluid cylinder as the fluid cylinder is adjusted longitudinally within the fixed tube.

3. The apparatus of claim 1, further including a horizontally extending control system platform fixed adjacent to the end of the tube and a system on the control platform having means for allowing fluid to pass from an external source through the fluid line to pressurize the fluid cylinder so as to raise the supporting platform and having means for releasing fluid from the fluid cylinder in order to lower the supporting platform.

4. The apparatus of claim 3, wherein the fluid cylinder has a longitudinal length greater than that of the tube.

5. The apparatus of claim 3, further including a strut extending from the control system platform to one of the legs of the tripod, the strut is spaced from the tube to provide a carrying handle.

6. The apparatus of claim 1, further including a wobble connection between the object supporting plate and the distal end of the piston rod for allowing the object supporting platform to pivot slightly with respect to the piston rod so as to facilitate holding objects such as cabinets in close proximity with a wall.

7. The apparatus of claim 1, wherein the feet of the tripod support have flat surfaces which rest in direct contact with the floor.

8. The apparatus of claim 7, wherein horizontal braces extend between the legs of the tripod support in vertical spaced relation with respect to the feet so that any debris on the floor does not interfere with stable positioning of the tripod support.

9. The apparatus of claim 1, wherein the platform at the distal end of the piston rod is positioned approximately thirty-two inches from the feet of the tripod whereby cabinets may be set upon the tripod at approximately waist high level.

10. The apparatus of claim 1, wherein the fluid cylinder is a pneumatic cylinder and the working fluid is compressed air.

11. The apparatus of claim 1, further including a horizontally extending control system platform fixed adjacent to the end of the fixed tube and a system on the control platform having means for allowing fluid to pass from an external source through the fluid line to pressurize the fluid cylinder so as to raise the supporting platform and having means for releasing fluid from the fluid cylinder in order to lower the supporting platform; and a hole in the control system platform for receiving the shank of an automatic screwdriver so as to support same during use of the apparatus.

12. A lifting device for hoisting wall mounted cabinets, ceiling frames and the like, the lifting device comprising:

a tripod support having three feet for resting the device on a floor;

a tube defined by a wall fixed within said tripod;

a fluid cylinder telescopically received within the tube, the fluid cylinder having a bottom end;

a plurality of stations defined on the fixed tube for receiving stop means to longitudinally position the fluid cylinder in the tube at a selected one of the stations;

means connected to the fluid cylinder for pressurizing the cylinder, wherein the means for pressurizing the fluid cylinder includes a fluid hose connected to the bottom end of the fluid cylinder and wherein the tube telescopically receiving the fluid cylinder has a slot in the wall thereof extending longitudinally with respect thereto through which slot the fluid line is received, whereby the fluid line can conveniently follow the fluid cylinder as the fluid cylinder is adjusted longitudinally within the tube;

piston means within the fluid cylinder for extending longitudinally upon pressurizing the fluid cylinder;

extension means extending from the piston means for longitudinal movement therewith, the extension means having a distal end; and a supporting platform mounted on the distal end of said extension means for supporting the object to be lifted.

13. A lifting device for hoisting wall mounted cabinets, ceiling frames and the like, the lifting device comprising:

a tripod support having three feet for resting the device on a floor;

a tube supported within said tripod;

a fluid cylinder telescopically received within the tube, a plurality of stations defined on the tube for receiving stop means to longitudinally position the fluid cylinder in the tube at a selected one of the stations;

means connected to the fluid cylinder for pressurizing the cylinder;

piston means within the fluid cylinder for extending longitudinally upon pressurizing the fluid cylinder;

extension means extending from the piston means for longitudinal movement therewith, the extension means having a distal end;

a supporting platform mounted on the distal end of said extension means for supporting the object to be lifted; and a horizontally extending control system platform fixed adjacent to the end of the fixed tube and a system on the control platform having means for allowing fluid to pass from the external source through the fluid line to pressurize the fluid cylinder so as to raise the supporting platform; the control platform having means thereon for releasing fluid from the fluid cylinder in order to lower the supporting platform, the control platform further having a hole in the control system platform for receiving the shank of an automatic screwdriver so as to support same during use of the apparatus.

* * * * *